US011013256B2

(12) United States Patent
Anderson

(10) Patent No.: US 11,013,256 B2
(45) Date of Patent: May 25, 2021

(54) DEVICE AND METHOD FOR FORMING A CIGAR SHAPED OBJECT

(71) Applicant: CANNAGAR SOLUTIONS, LLC, Rogersville, MO (US)

(72) Inventor: Kelly Anderson, Rogersville, MO (US)

(73) Assignee: CANNAGAR SOLUTIONS, LLC, Galena, MO (US)

( * ) Notice: Subject to any disclaimer, the term of this patent is extended or adjusted under 35 U.S.C. 154(b) by 245 days.

(21) Appl. No.: 16/009,162

(22) Filed: Jun. 14, 2018

(65) Prior Publication Data

US 2018/0360102 A1 Dec. 20, 2018

Related U.S. Application Data

(60) Provisional application No. 62/520,441, filed on Jun. 15, 2017.

(51) Int. Cl.
*A24C 1/18* (2006.01)
*A24C 1/02* (2006.01)

(52) U.S. Cl.
CPC . *A24C 1/18* (2013.01); *A24C 1/02* (2013.01)

(58) Field of Classification Search
CPC ..... A24C 1/02; A24C 1/16; A24C 1/18
USPC ..... 131/86, 85
See application file for complete search history.

(56) References Cited

U.S. PATENT DOCUMENTS 3,732,873 A * 5/1973 O'Rear ..... A24C 5/42 131/329
2010/0012134 A1* 1/2010 Herbst ..... A24C 1/18 131/86
2012/0138075 A1* 6/2012 Jespersen ..... A24C 5/40 131/280

FOREIGN PATENT DOCUMENTS

GB 191419225 A * 8/1915 ..... A24C 1/18

* cited by examiner

*Primary Examiner* — Eric Yaary
*Assistant Examiner* — Jennifer A Kessie
(74) *Attorney, Agent, or Firm* — Kutak Rock LLP; James H. Jeffries

(57) ABSTRACT

The present disclosure relates to a device and method for forming a cigar shaped object. A mold is provided having at least one cigar shaped pocket, a rod aligned within the pocket and a separate tamping device. The tamping device has a stem and handle with a bore in the stem larger than the diameter of the rod. Tobacco or other smoking material is placed in the pocket and the tamping device is used to compress the material which forms a cigar-shaped tube by placing the tamping device onto the rod and repeatedly moving it up and down to tamp or compress the material. The rod, when removed, creates a bore through the smoking material to improve and control air draw. After removal from the mold, the packed smoking material may be wrapped in any appropriate wrapper material.

14 Claims, 14 Drawing Sheets

DEVICE AND METHOD FOR FORMING A CIGAR SHAPED OBJECT

CROSS-REFERENCE TO RELATED APPLICATIONS

This application claims the benefit of U.S. Provisional Patent Application Ser. No. 62/520,441 filed Jun. 15, 2017, the disclosure of which is incorporated herein by reference.

BACKGROUND

The present invention relates to a molding device for forming a cigar shaped object. More particularly, the device is a molding block with at least one forming bore, a rod for creating an opening through the molded device and a separate tamping device with a bore matable to the rod which is used to physically tamp and compress materials positioned within the forming bore. The anticipated and intended use and application for the inventive device is to create compressed cigar-shaped articles for smoking where the articles are formed by tightly compressing and packing loose product, such as loose tobacco, cannabis buds or other materials that are intended for smoking.

It is well known to press leaf tobacco to form cigars. Traditionally, cigar presses are comprised of two parts, with each part having half of a cigar shaped recess. Leaf tobacco is rolled and placed into the press. When the two parts are mated together and secured, the press forms the leaf tobacco into the cigar shape of the mated halves of the press. This process also compresses the tobacco leaf together which imparts characteristics on each cigar such as the ability to draw air through the cigar, the rate of burn and the formation of ash.

It is desirable to form cigar shaped smoking articles from loose tobacco product, ground or shredded product, or other materials, including cannabis, hereinafter referred to as "smoking materials". To date, these cigar shaped articles have been made by tightly winding string around the smoking material, then wrapping at least a portion of a tobacco leaf around the bound material. This process is time consuming, is difficult to perform and results in significant variations in the resulting products. It is known that smoking materials need to be compressed at a density that optimizes the draw of air through the materials in order to keep the product lit as it is smoked. If too tightly wound, or too loosely wound, the air draw cannot be achieved as desired. It can also be difficult to keep the smoking material in the tobacco leaf, paper, or other wrapper if it is too loosely wound.

It has been determined that a far superior way to create a cigar shaped smoking article from loose smoking material is to tightly pack it within a mold. One way of doing so is to fill a device with the smoking material and substantially compress it with a tamping device. However, when the smoking material is compressed tightly enough to maintain its shape, form and size, it is difficult, if not impossible, to achieve a desired draw of air through the article.

The instant invention overcomes these drawbacks and limitations by providing an innovative device for molding the smoking material into a cigar shape, creating a tightly packed product capable of maintaining its shape, form and size while simultaneously creating a through-bore or channel through the product to facilitate air draw through the final cigar product.

SUMMARY

Embodiments of the present disclosure relate to a mold and tamper for forming a cigar shaped smoking article. The invention includes a mold having a pocket or cavity, with a first opening at one end for adding smoking material, a smaller, second opening at the second end for removably inserting a rod which is aligned substantially in the middle of the pocket. The rod is captured and held by clamping force within the small opening at the second end and preferably is long enough to substantially span the length of the mold pocket.

In some embodiments, the tamping device includes a stem and a handle. The handle is formed or attached at the upper end of the tamping device and the handle can be virtually any shape capable of being grasped. The orientation, size, and configuration of the handle is not essential to the function or inventive aspect of the tamping device. It is preferred that the stem is slightly longer than the length of the pocket formed by the mold. An opening at the lower end of the tamping device, opposite the handle, axially aligns with and is connected to a bore formed through the length of the stem. The opening and aligned bore are slightly larger in diameter than the diameter of the rod positioned within the mold pocket so that the tamping device can be slid along the length of the rod as the rod can travel freely within the stem bore.

In a preferred embodiment, the mold is provided in two pieces or sides. The mold has two sides, each including a recess so that when the two mold sides are positioned together, a full cigar-shaped pocket or cavity is formed by the two recesses. The size of the rod used to form the bore through the smoking article can also vary in diameter and length. As a general guideline, but not requirement, the larger the smoking article to be formed, the larger the diameter of the rod. It should be evident that any number of pockets or cavities could be formed in a mold varying only by the length, diameter, contour, or shape of each recess, and the dimensions of the mold sides. The two sides can be connected by any conventional means, including at least one mechanical fastener, such as a threaded bolt and nut. Other embodiments may utilize a sleeve that surrounds the side pieces, string or cord wrapped around the side pieces, spring clamps, machine screws, or any other device suitable to secure the two side pieces together.

In one embodiment, the method of forming a cigar-shaped smoking article using the device described herein includes the following steps. A rod is inserted in the small opening of the second end of a pocket in one of the mold sides. The rod is captured in place, and aligned axially within the pocket by clamping force when the second mold side is positioned onto and secured to the first mold side. The smoking material selected is placed into the mold pocket, the tamping device is positioned onto the rod and is manipulated up and down along the rod to tamp and compress the smoking material into the pocket and against the surfaces of the recesses in each mold side. As the material is compressed and molded into the pocket, additional material is added through the first opening to fill the space created during the tamping process. When the mold pocket is filled to the desired level with material compressed to the desired density and compactness, the two mold sides are disconnected and separated, allowing direct access to the molded smoking article formed from the compressed smoking material. The rod is removed from the article and then the article is further processed as desired. For example, it is beneficial to wrap the molded smoking article in one or more tobacco leaves to maintain the structural integrity of the article.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

The inventive device comprises a mold having at least one pocket formed in the mold for forming a cigar-shaped object from smoking materials. In a preferred embodiment the mold is formed from two side pieces. Each side piece includes at least one recessed mold portion so that when the two mold side pieces are positioned together, a full cigar-shaped pocket is formed by the matching mold recesses. The mold recesses are generally semi cylindrical extend to the edges of each side piece so that a first opening is formed at one end that allows the user to place smoking materials into the pocket for compacting as described below. In some embodiments of the inventive device, the edges of mold recess are beveled, chamfered, or cut in from the side surface of the side pieces at the open end so that the opening in the side of the mold is similarly beveled, chamfered, or cut in to aid in placing smoking material into the pocket.

A smaller rod recess is provided in connection with each mold recess in each side piece The smaller rod recess is semi cylindrical, meaning that it has a semicircular cross-section and extends from and in substantial alignment with the mold recess to create a channel from the inner end of the mold recess toward the adjacent edge of the side piece. When the two side pieces are placed together, a channel is created by the matched rod recesses, preferably aligned with the substantial center axis of the cylindrical pocket. In some embodiments, the channel formed by the rod recesses extends to and forms an annular second opening in the side of the mold, while in other embodiments the rod recesses stop short of the edge of the side piece and do not form an opening in the side of the mold.

Clamping devices are provided to secure the two side pieces to each other during use, and a tamping device is provided to tamp smoking materials into the pocket formed in the device.

The inventive device may be made from wood, metal, plastic, composite materials, or any other rigid or semi-rigid material capable of being cast, molded, or machined into the required shapes. In some embodiments, the side pieces are formed from wood or aluminum, and the tamping device has a metal shaft and a plastic handle.

Figure 1:
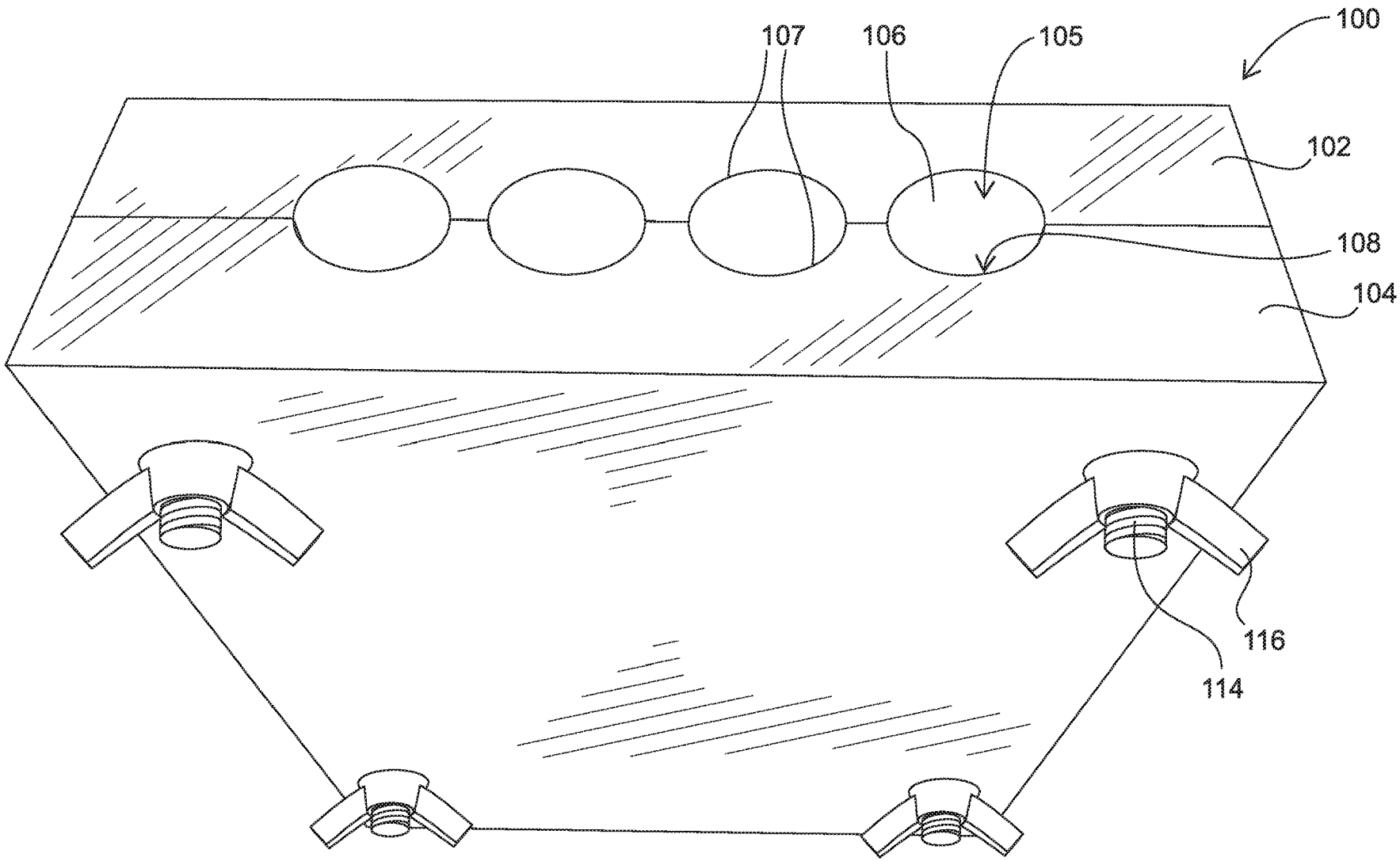
FIG. 1 depicts a top perspective view of an embodiment of the inventive device.

Referring now to FIG. 1, a top perspective view of an embodiment of the inventive device 100 is depicted. The depicted embodiment of the device 100 comprises a first side piece 102 and a second side piece 104. In FIG. 1 the device 100 is depicted with the two side pieces 102 and 104 secured together. Side piece 102 is provided with four mold recesses 106, and side piece 104 is provided with four mold recesses 108. In the depicted embodiment of the device 100 there are four mold recesses on each side piece but in other embodiments of the inventive device, the number of mold recesses could be from one to any number that physically fit onto the side pieces 102 and 104 used to form the device 100. The mold recesses 106 and 108 have a substantially semi cylindrical shape, meaning they have a semicircular cross-section and extend across a portion of the inner surface of each side piece 102 and 104.

In the depicted configuration when the side pieces 102 and 104 are placed with their inner surfaces touching and are in alignment, the mold recesses 106 and 108 are disposed adjacent to each other forming a pocket 105. The shape of the mold recesses 106 and 108 create a pocket 105 that is substantially cylindrical, though each mold recess 102 and 104 may have an inner end 109 that is semi-hemispherical, meaning half of a hemisphere, so that the pocket has an hemispherical inner end. A first opening for the pocket is created at the outer end 107 of each mold recess, where the mold recesses 106 and 108 intersect with the top surface of each side piece 102 and 104.

Figure 2:
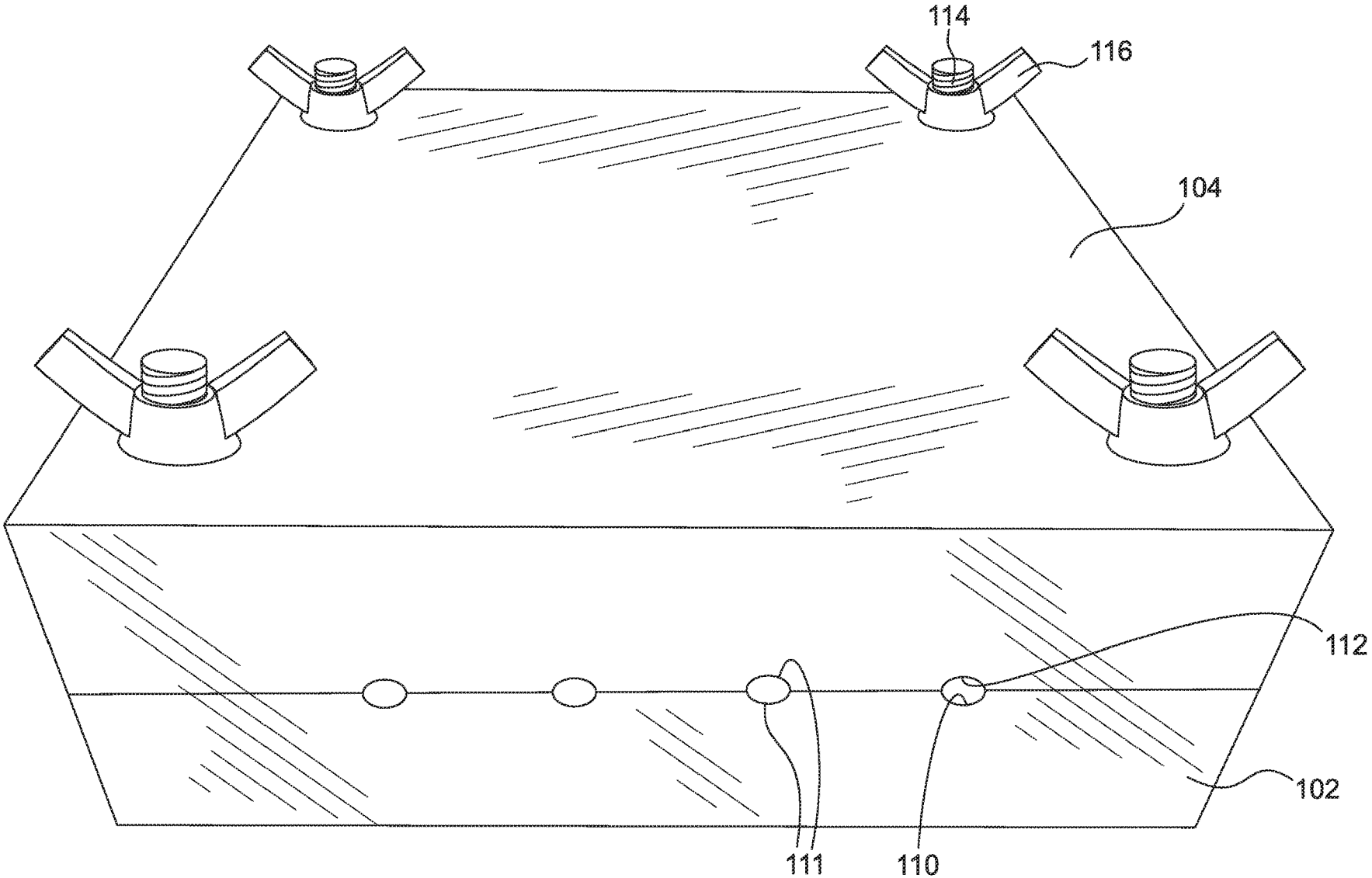
FIG. 2 depicts a bottom perspective view of an embodiment of the inventive device.

Referring now to FIG. 2, a bottom perspective view of an embodiment of the inventive device is depicted. This figure shows the device from the opposite end as that depicted in FIG. 1. In the depicted embodiment, the outer ends 111 of the rod recesses 110 and 112 in side pieces 102 and 104, respectively, create a second opening for each pocket. The rod recesses 110 and 112 have a substantially semi cylindrical shape, meaning they have a semicircular cross-section similar to recesses 106 and 108, but the radius of the semicircular cross-sections are smaller in the rod recesses 110 and 112 in comparison to the radius of the mold recesses 106 and 108. The rod recesses 110 and 112 extend from the inner end of each mold recess 106 and 108 toward the bottom surface of side pieces 102 and 104. In some embodiments, the rod recesses 110 and 112 extend all the way to the bottom surface of the side piece and form a second opening for the pocket where they intersect with the bottom surface of each side piece 102 and 104. In other embodiments, the rod recesses 110 and 112 extend only partially toward the bottom surface of the side pieces and do not create a second opening, as shown and described below in relation to FIG. 7C.

Figure 3:
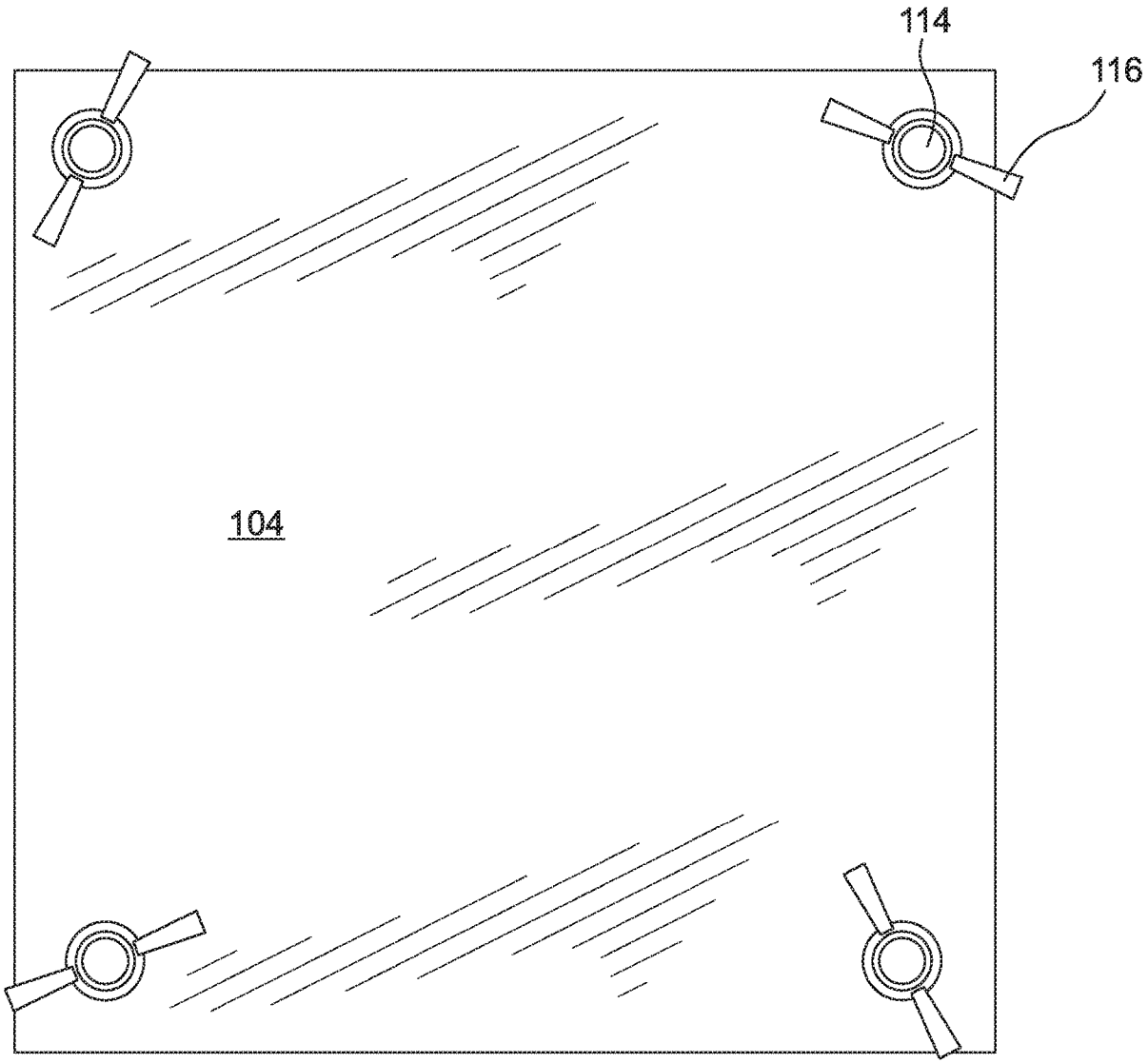
FIG. 3 depicts a side plan view of an embodiment of the inventive device.
Figure 4:
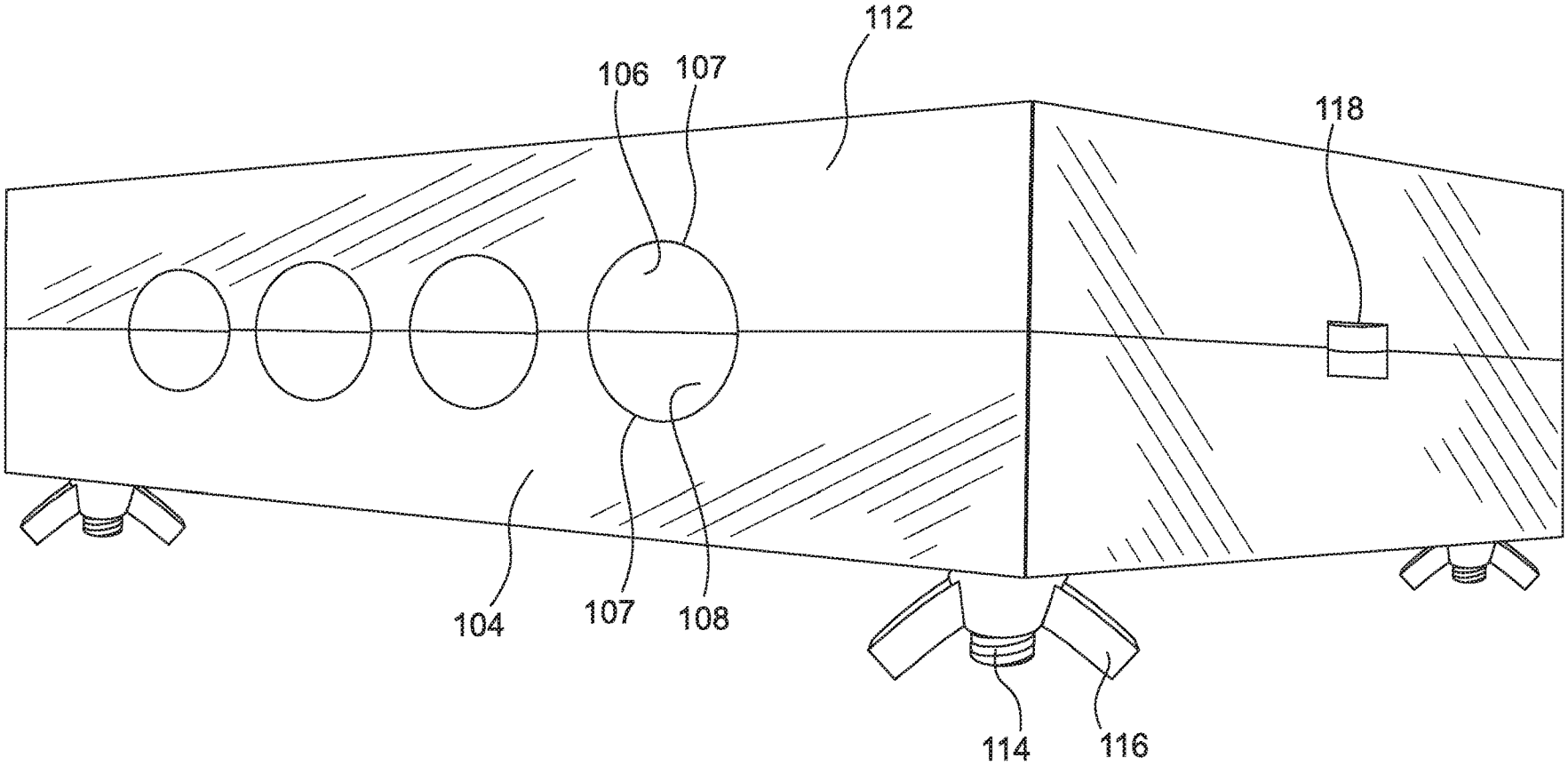
FIG. 4 depicts a side perspective view of an embodiment of the inventive device.

Referring now to FIGS. 3 and 4, side views of an embodiment of the inventive device are depicted. Clamping devices are provided to secure the two side pieces 102 and 104 together with their inner surfaces in contact and with the recesses in proper alignment. These clamping devices may be separate from the inventive device 100 and be clamps typically used in metalworking or woodworking to secure two pieces of material together in a fixed relationship. In some embodiments, such as those shown in the figures, the clamping device may be integrated into the inventive device 100.

In the depicted embodiment, the clamping devices consist of nuts and bolts. Bolts 114 extend through holes 120 in side piece 104 and are secured by nuts 116 on the outer surface of side piece 104 to clamp the two side pieces together. In various embodiments, the bolt 114 may extend through a matching hole in side piece 102 and be provided with a bolt head on the outer surface of side piece 102 to exert a clamping force on side piece 102. In other embodiments, bolts 114 may be secured in threaded holes 120 in side 102 that extend partially or completely through side 102. In some embodiments, the clamping device may comprise a sleeve that fits around the side pieces to hold them in place. In other embodiments, it includes string or cord wound around the side pieces to hold them together. The exact type of clamp is not limiting of the scope of the inventive device.

In other embodiments, the number and location of the clamping devices may vary as necessary to securely clamp the two side pieces 102 and 104 together and prevent separation between the two side pieces 102 and 104 as material is tamped into the pockets.

Referring to FIG. 4, some embodiments are provided with a indentations 118 in side pieces 102 and 104. These indentations provide a point of leverage to separate the side pieces after use.

Figure 5:
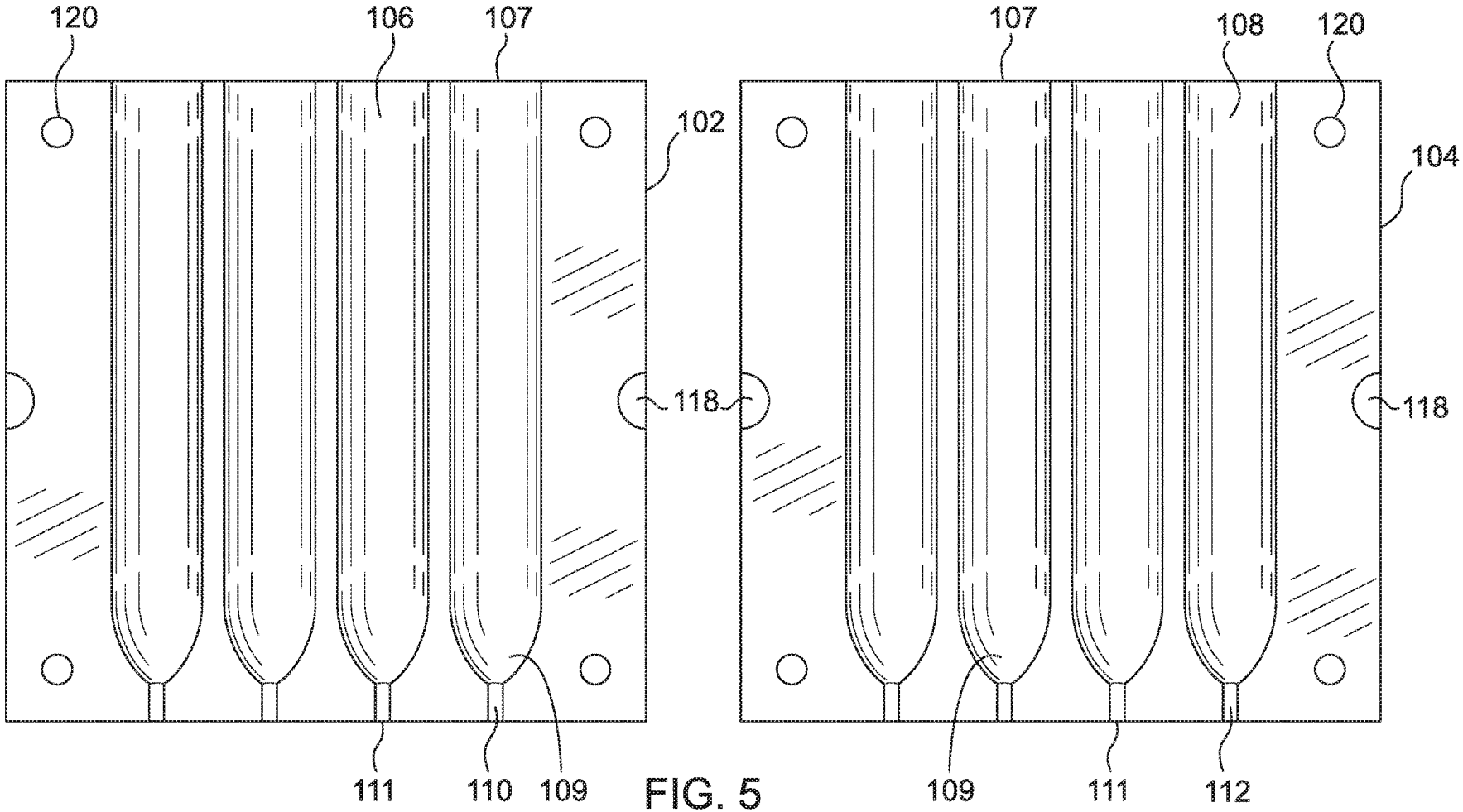
FIG. 5 is a partial exploded view of an embodiment of the inventive device.

Referring now to FIG. 5, the device 100 is depicted with the two side pieces 102 and 104 separated in a book wise fashion with the inner surface of each side piece depicted. The mold recesses 106 and 108 are shown with an outer end 107 and an inner end 109. In the depicted embodiment, the inner end 109 of each mold recess is approximately half of a hemisphere, but the hemisphere is slightly elongated from a true hemisphere. This inner end 109 may have a variety of different shapes in various embodiments, and the exact shape depicted here is not limiting of the invention. Rod recesses 110 and 112 are shown extending across the inner surfaces of the side pieces 102 and 104 from the inner end 109 of the mold recesses 106 and 108 to the adjacent bottom surface of the side pieces at outer end 111. The rod recesses 111 and 112 are substantially aligned with the central lengthwise axis of the mold recesses 106 and 108, though in some embodiments it may be the case that the rod recesses 110 and 112 are not exactly in alignment with the central axis of the mold recesses.

Figure 6:
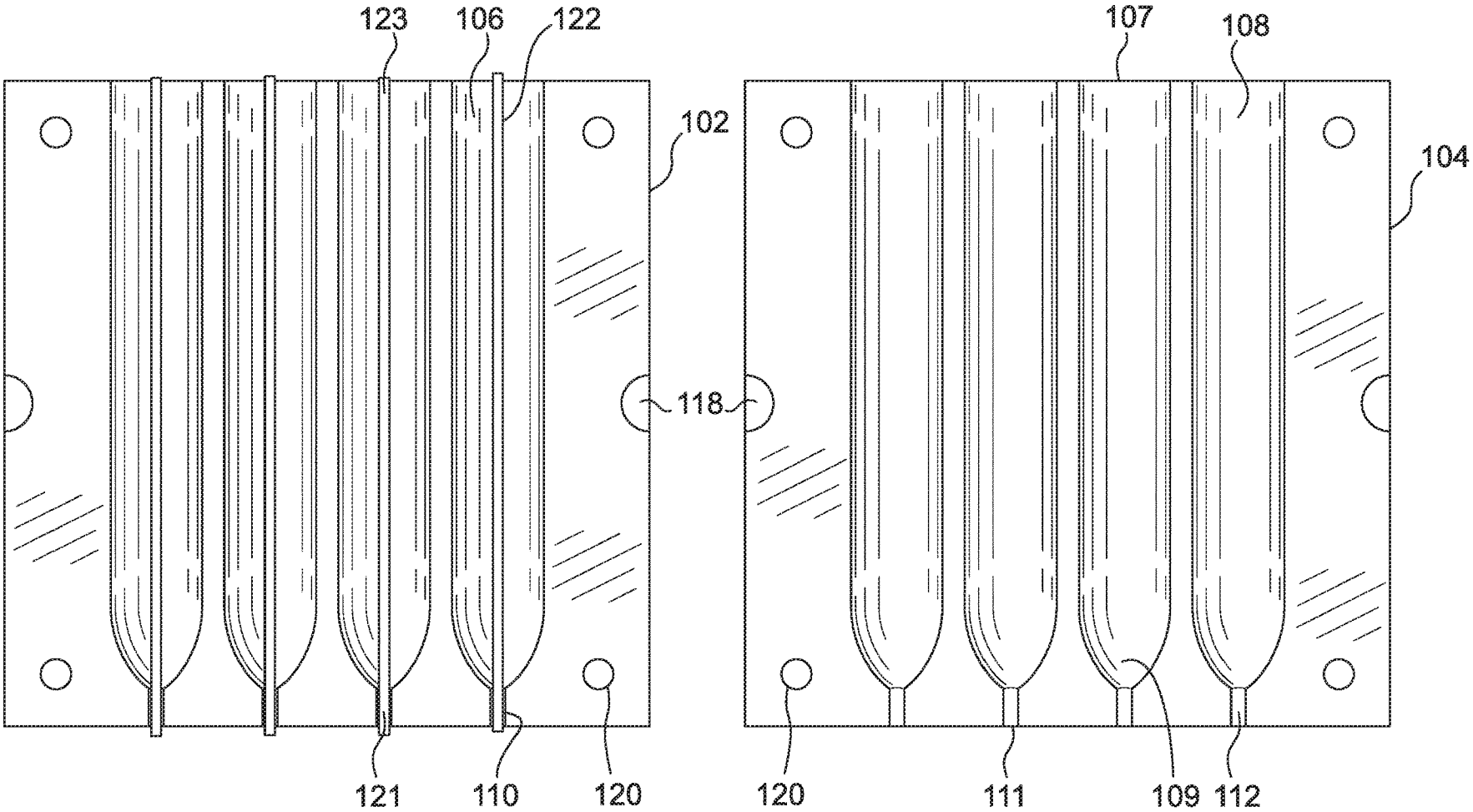
FIG. 6 is a partial exploded view of an embodiment of the device.

Referring now to FIG. 6, the device is depicted with the two side pieces 102 and 104 separated in a book wise fashion. The semicircular cross-sections of the rod recesses 110 and 112 have a diameter that is selected in varying embodiments such that when the two side pieces 102 and 104 of the device are attached together, the second opening is slightly smaller than a rod 122, having a preferred diameter, which is captured between the rod recesses 110 and 112 by clamping force and maintained within the second opening as the two sides 102 and 104 of the device are secured together. In use, a first end 121 of the rod 122 is placed in one of the rod recesses 110 such as shown in FIG. 5 with the length of the rod 122 positioned within the pocket 105 so that the second end 123 of the rod 122 is near the outer end 107 of the mold recess 106. The other side piece 104 is placed onto the first side piece 102 and the first end 121 of the rod 122 is captured in the channel formed by the two rod recesses 110 and 112 as they align and are clamped. This causes the rod 122 to generally align with the central axis of the pocket 105.

Figure 7A:
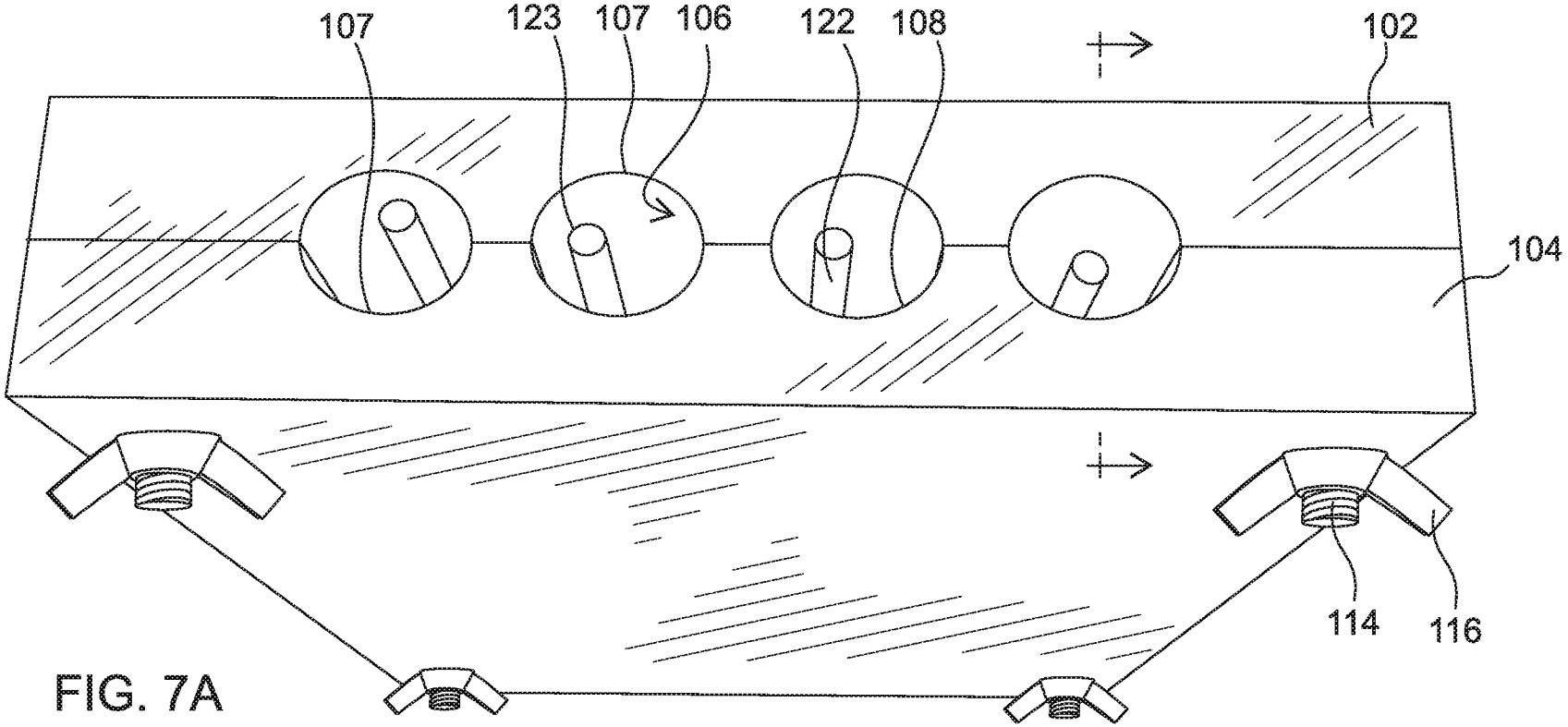
FIG. 7A is a perspective view of an embodiment of the inventive device with rods disposed in the pockets of the device.
Figure 7B:
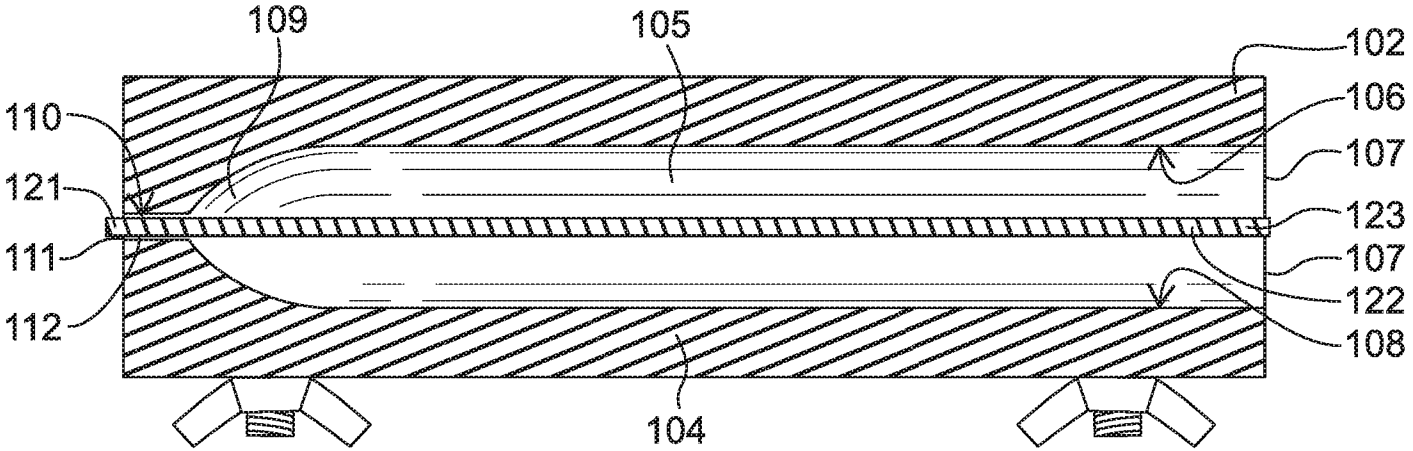
FIG. 7B is a cross-sectional view of an embodiment of the inventive device.

Referring now to FIGS. 7A and 7B, a top perspective view and a cross-sectional view, respectively, of the device 100 with rods 122 secured in the pockets 105 are depicted. The rod 122 is approximately aligned with the central lengthwise axis of pocket 105 and extends along substantially all of the length of the pocket 105, though in other embodiments it may extend less than or more than the length of the pocket 105. When loose material is compressed into pocket 105 the rod 122 will cause a bore to be created in the resulting smoking article, which after removal from the mold and withdrawal of the rod 122 from the smoking article will provide a channel for airflow.

In various embodiments of the device 100, the size of the rod 122 used to form the bore through the smoking article can also vary in diameter and length. As a general guideline, but not requirement, the larger the cross-sectional area of the smoking article to be formed, the larger the diameter of the rod 122. In some embodiments the rod 122 may not extend along the entire length of the pocket 105 and thus may create a bore through only a portion of the smoking article.

Figure 7C:
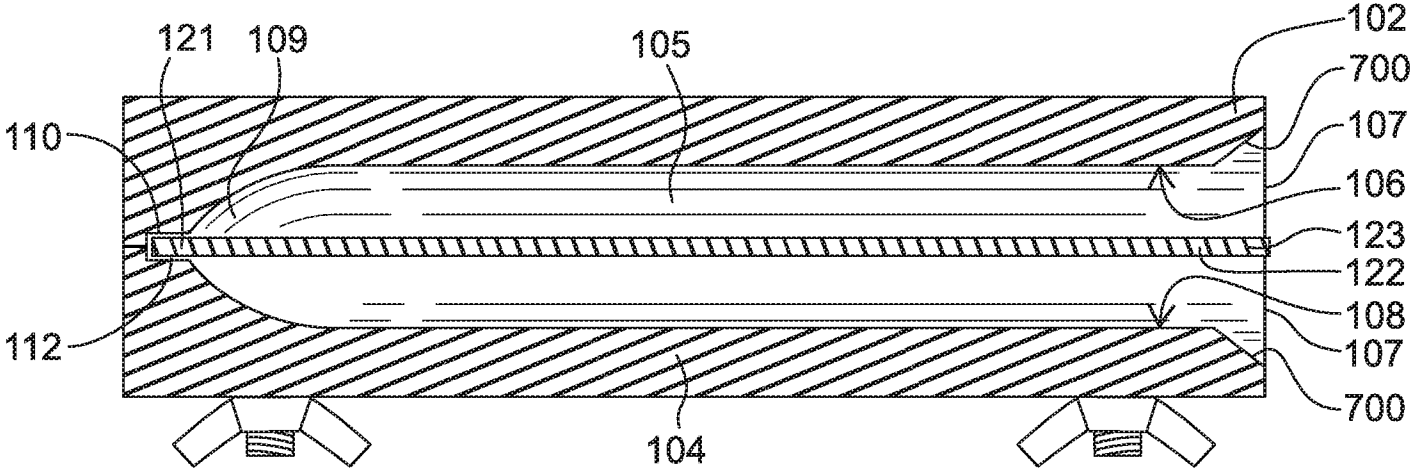
FIG. 7C is a cross-sectional view of an embodiment of the inventive device.

Referring now to FIG. 7C, a cross-sectional view of another embodiment of the device 100 is depicted. This depicted embodiment has rod recesses 110 and 112 that do not extend completely to the bottom surface of the side pieces, but stop adjacent thereto. In these embodiments, the rods do not extend out the bottom of the side pieces. The embodiment depicted in FIG. 7C is also provided with beveled edges 700. The edges may be beveled edges, chamfered edges, rounded edges, cove molded, or otherwise cut-in edges so that a smoking material may more easily be placed into the pocket.

Figure 8:
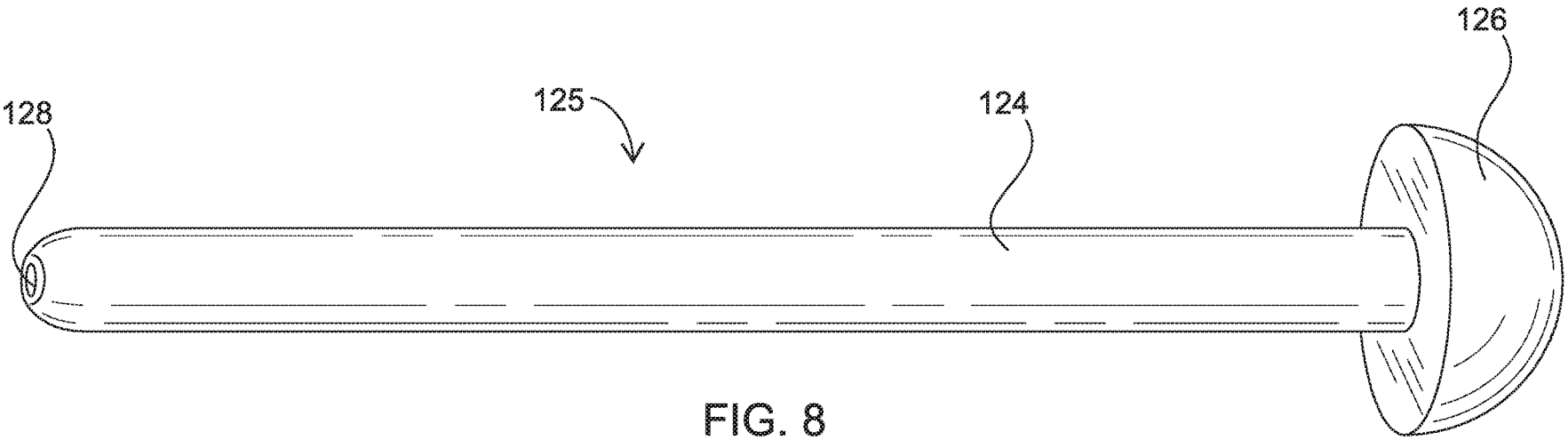
FIG. 8 is a perspective view of an embodiment of a tamping device for use with an embodiment of the inventive device.
Figure 9:
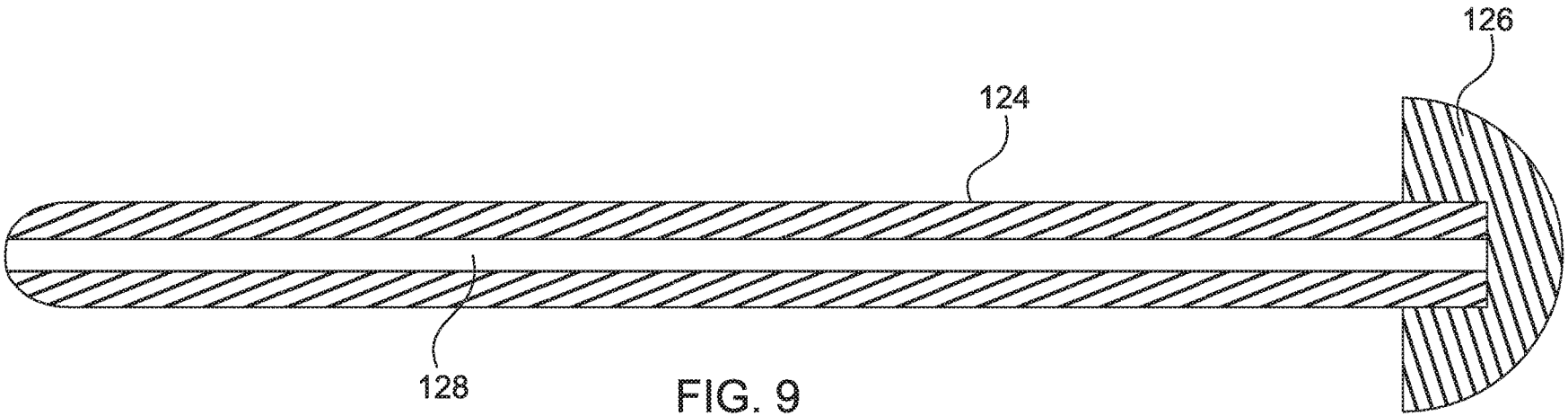
FIG. 9 is a cross sectional view of an embodiment of a tamping device.
Figure 10:
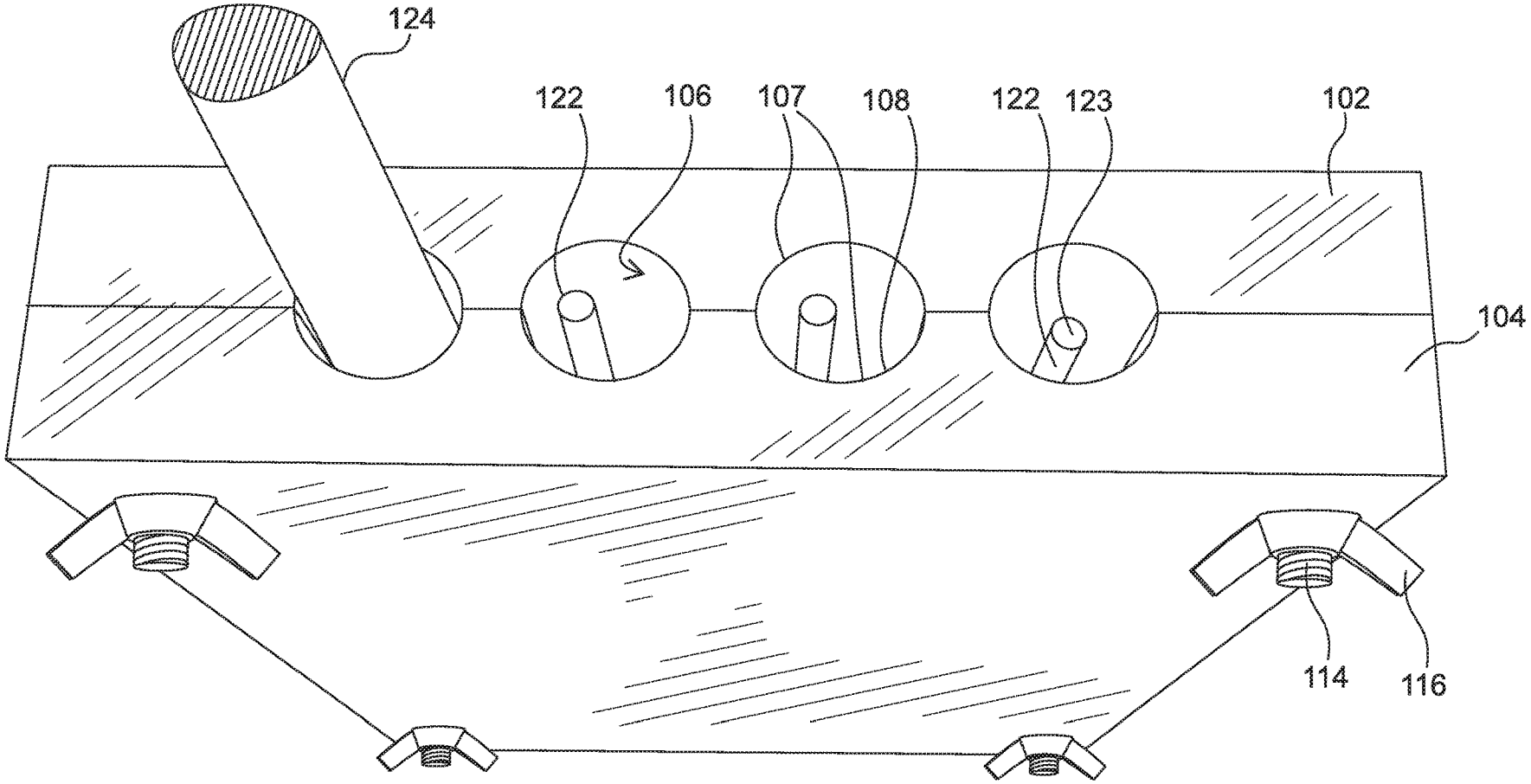
FIG. 10 is a perspective view of an embodiment of the inventive device with a tamping device placed on one of the rods and inserted into one of the pockets.
Figure 11:
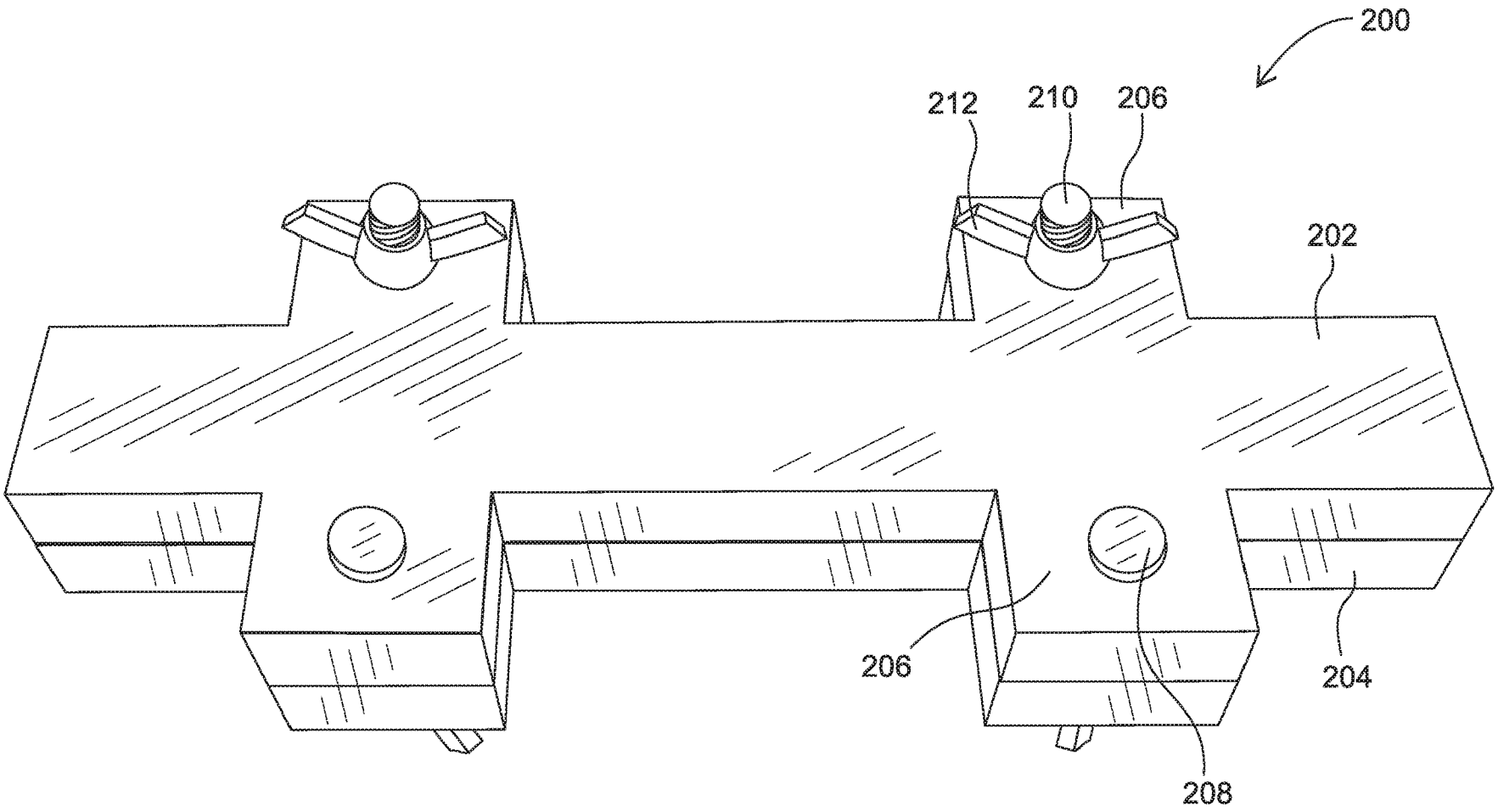
FIG. 11 is a perspective view of a second embodiment of the inventive device.
Figure 12:
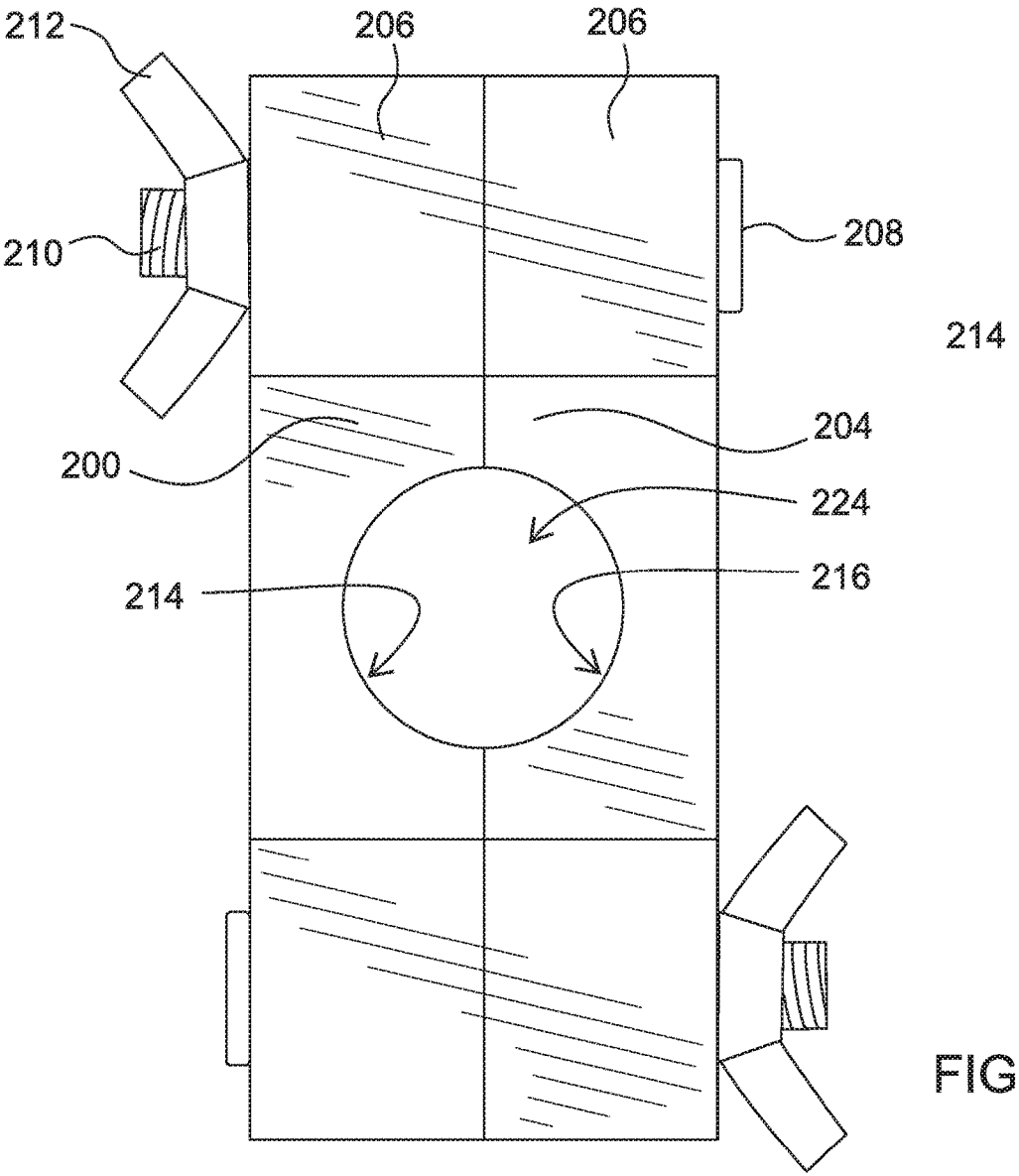
FIG. 12 is an end plan view of the second embodiment of the inventive device.
Figure 13:
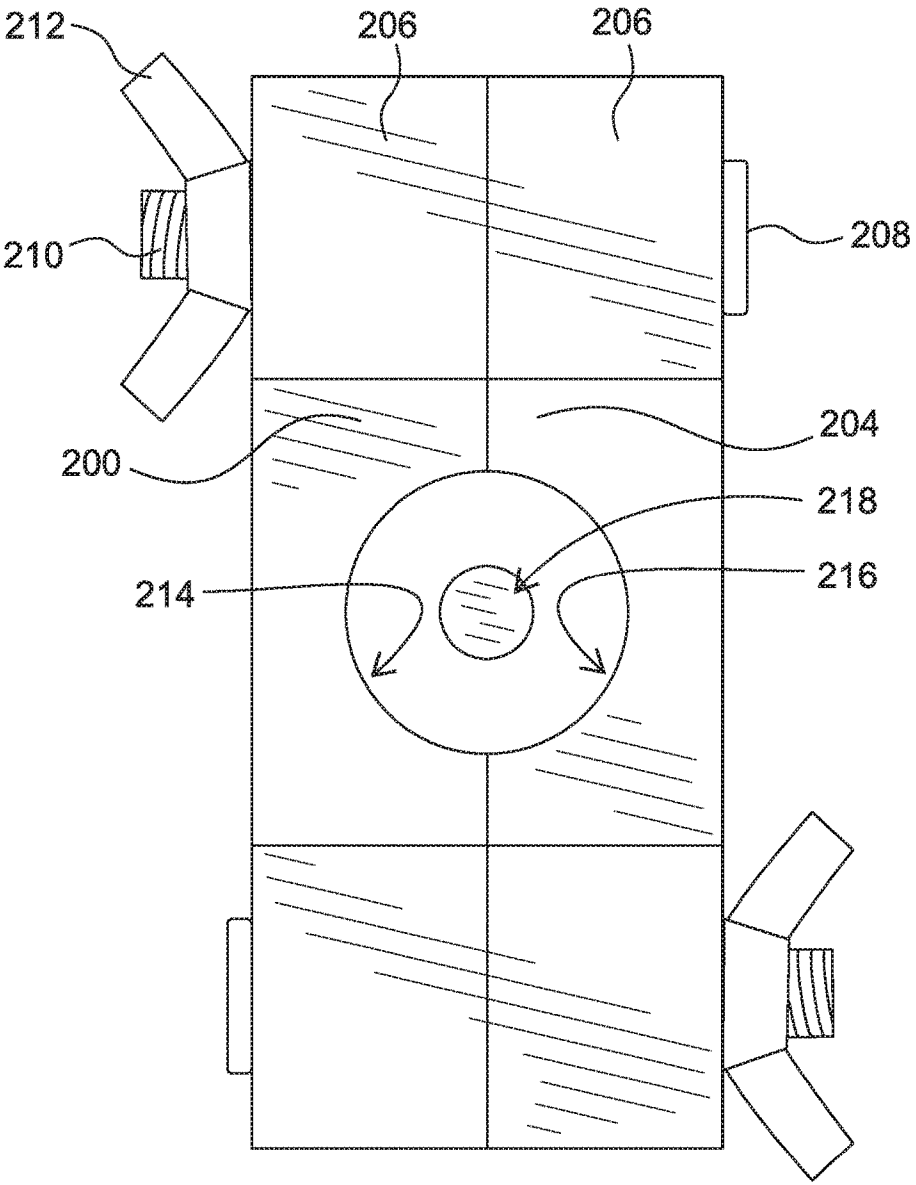
FIG. 13 is an end plan view of the second embodiment of the inventive device with a rod disposed in a pocket in the device.
Figure 14:
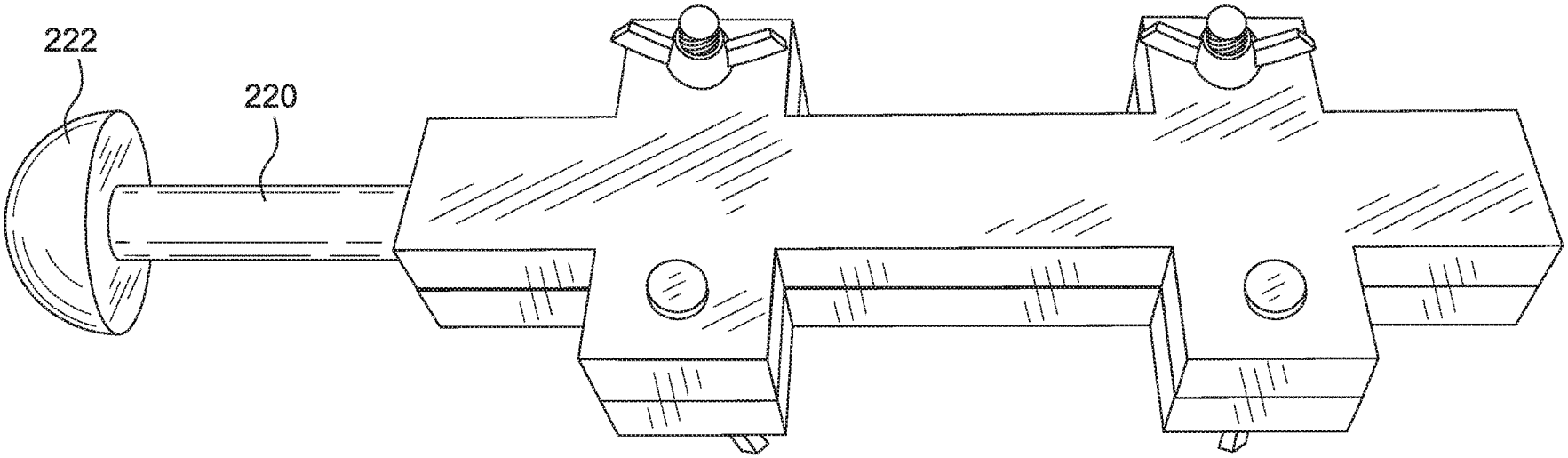
FIG. 14 is a perspective view of the second embodiment of the inventive device with a tamping device placed on the rod and inserted into the pocket.

In embodiments of the invention, a tamping device 125 is provided to allow loose material to be tamped down into the pocket 105 and compressed to a desired density. Referring now to FIGS. 8 and 9, a perspective view and a cross-sectional view, respectively, of the tamping device 125 are depicted. The stem, or tamping rod, 124, or at least a portion of the stem near the tip of the stem, is sized to match the pocket 105 with which it will be used. In some embodiments, the tamping rod 124 has removable, interchangeable tips of varying size to fit a variety of pocket sizes. The cross-sectional shape of the tamping rod 124 should be similar in proportion but slightly smaller than the cross-section shape of the pocket 105. In some embodiments, the pocket 105 is cylindrical and the tamping rod 124 of the tamping device 125 is also cylindrical with a diameter slightly smaller than the pocket 105. The slightly smaller size of the tamping rod 124 need only be enough to allow the tamping rod 124 to slide freely into and out of the pocket 105 during use.

In some embodiments, the tamping device 125 includes a handle 126 to increase the comfort and safety of a user who is using the tamping device. In various embodiments, the handle 126 is formed or attached at the first end of the tamping rod 124 of the tamping device 125 and the handle 126 can be virtually any shape capable of being grasped and allowing a user to exert force through the handle 126 to the tamping rod 124 to compress material into the pocket 105. The material, orientation, size and configuration of the handle 126 is not essential to the function or inventive aspect of the device 100. In the depicted embodiment, the handle is hemispherical, but in other embodiments it may be spherical. In various embodiments of the tamping device 125, the handle 126 may be formed integrally with the tamping rod 124, or otherwise permanently or removably attached thereto.

It is preferred that the tamping rod 124 is slightly longer than the length of the pocket 105 so that when it is fully inserted into the pocket 105 it reaches substantially to the inner end 109 of the pocket 105. The tamping rod 124 has a bore 128 extending along all or a portion of its length. An opening at the second end of the tamping device 125, opposite the handle 126, axially aligns with and is connected to the bore 128 formed through the length of the stem. The opening and aligned bore 128 are slightly larger in diameter than the diameter of the rod 122 positioned within the mold pocket 106 so that the tamping rod 124 of the tamping device 125 may be slid along the length of the rod 122 as the rod is capable of being freely inserted into the stem bore 128. In some embodiments of the tamping device 125, the second end of the tamping rod 124 is chamfered around the opening so that the lower end is rounded, or convex. This chamfer aids in the compaction of the smoking material and limits shredding which can be caused by an edge.

Referring now to FIGS. 11, 12, 13, and 14, perspective and plan views of a second embodiment 200 of the device are depicted. In this embodiment of the device there is only a single pocket 224. Side pieces 202 and 204 with mold recesses 214 and 216, rod 218, and tamping rod 220 provide the same functions of the first embodiment in a smaller device. Extensions 206 are provided on each side piece 202 and 204 to provide space for clamping devices such as bolt 210 with bolt head 208 and nut 212 exerting clamping pressure on the side pieces. Handle 222 is provided on the stem 220 for ease of use.

In various embodiments of the device 100, any number of pockets, or molds, 105 may be formed in a device, and each mold 105 may vary by the length, diameter, contour or shape of each recess 106 and 108, and the dimensions of the side pieces. Preferred configurations have, one, four or eight pockets formed in the device. It is also understood that "cigar shaped" is a general term which comprises many shapes which are generally tubular. All sizes, circumferences, lengths and tapers of such cigar shaped articles can be formed with the inventive device by altering the dimensions and contours of the mold pockets. In some embodiments multiple tamping devices 125 may be attached together in a configuration matching the various pockets in the device 100 to allow tamping to occur in multiple pockets 105 simultaneously.

In some embodiments, one or more of the side pieces may have mold and rod recesses on both sides of the side piece, thus allowing 3 or more side pieces to be clamped together to form an array of pockets. These embodiments provide for the production of a large number of cigar shaped objects simultaneously and potentially the automation of tamping of multiple pockets at the same time by machine device.

In various embodiments, the method of forming a cigar-shaped smoking article using the device described herein includes the following steps. A rod 122 is inserted in one of the side pieces 103 or 104 with a first end 121 of the rod 122 in the rod recess 110 or 112, respectively, and the second end 123 of the rod 122 disposed in the mold recess 106 or 108, respectively. The rod 122 is captured in place, and aligned axially within the pocket 105 by clamping force exerted by the rod recesses 110 and 112 when the second mold piece, 104 or 102, respectively, is positioned onto and secured to the first mold piece 102 or 104. A first portion of the selected smoking material is placed into the mold pocket 105 through the first opening created by the outer ends 107 of the mold recesses 106 and 108. The tamping rod 124 of the tamping device 125 is positioned with the first end 121 of rod 122 inserted into the bore 128 within tamping rod 124. The tamping device 125 is manipulated up and down along the rod 122 within pocket 105 to tamp and compress the smoking material into pocket 105. As the material is compressed and molded into the pocket 105, additional portions of material may be added as desired. When the mold pocket 105 is filled to the desired level and tamped to the desired density, the clamping devices are released and the two mold side pieces 102 and 104 are separated to allow access to the molded smoking article, which may then be removed from the mold side piece. The rod 122 may then be withdrawn or removed from the article. Either before or after the removal of the rod, the article may be treated with additional processing steps as desired. For example, it may be desired to wrap the article in one or more plant leafs to maintain the structural integrity of the molded article.

Comprise, include, and/or plural forms of each are open ended and include the listed parts and can include additional parts that are not listed. And/or is open ended and includes one or more of the listed parts and combinations of the listed parts.

One skilled in the art will realize that the present disclosure may be embodied in other specific forms without departing from the spirit or essential characteristics thereof. The foregoing embodiments are therefore to be considered in all respects illustrative rather than limiting of the present disclosure. Scope of the present disclosure is thus indicated by the claims, rather than by the foregoing description, and all changes that come within the meaning and range of equivalency of the claims are therefore intended to be embraced therein.

What is claimed is:

1. A device for forming a cigar shaped object comprising:

a first side piece having a first mold recess and a first rod recess on an inner surface thereof;

a second side piece having a second mold recess and a second rod recess on an inner surface thereof;

wherein when the first side piece is clamped to the second side piece with the inner surface of the first side piece in contact with the inner surface of the second side piece in a clamped configuration, the first mold recess and the second mold recess define a pocket with an opening;

a first rod having a first and second end, wherein in the clamped configuration the first end of the rod is clamped between the first rod recess and the second rod recess, and the rod extends generally along a lengthwise axis of the pocket; and a tamping device having a tamping rod with a bore disposed therein with an opening at a first end of the tamping rod, wherein the bore is capable of receiving and moving along the first rod, and the tamping rod is capable of being received by and moving within the pocket.

2. The device of claim 1, wherein the first and second mold recess and the first and second rod recess are semi-cylindrical.

3. The device of claim 1, the first and second mold recess extend from an outer end at a first side surface of the first and second mold piece to an inner end disposed adjacent to a second side surface of the first and second mold piece, respectively.

4. The device of claim 3 wherein the first and second rod recess extend from near the second side surface of the first and second mold piece to the inner end of the first and second mold piece, respectively.

5. The device of claim 4, wherein the inner end of the first and second mold recess is semi-hemispherical.

6. The device of claim 5, wherein the tamping device is provided with a handle attached to a second end of the tamping rod.

7. The device of claim 6, wherein the first and second side pieces are provided with a plurality of first and second mold recesses to form a plurality of pockets in the clamped configuration.

8. The device of claim 7, wherein the first and second mold recesses vary in length and circumference from each other.

9. The device of claim 5, wherein the first end of the tamping rod is chamfered.

10. The device of claim 1, wherein the tamping handle is removable from the tamping rod.

11. A method for forming a cigar shaped object using the device of claim 1, comprising the steps of:

placing the first end of the rod in the first rod recess in the first side piece with the second end of the rod near the outer end of the first mold recess;

clamping the second side piece to the first side piece with the inner surfaces thereof in contact in a clamped configuration to define the pocket with the rod disposed therein;

placing a first portion of a smoking material into the pocket around the rod through the opening;

inserting the tamping rod into the pocket with the second end of the rod inside the bore of the tamping rod;

urging the tamping rod into the pocket toward the an inner end thereof to compress the smoking material into the pocket; and adding additional portions of smoking material to the pocket around the rod through the pocket and compressing the additional portions until the pocket is filled with compressed smoking material at a desired amount and density.

12. The method of claim 11, further comprising the step of removing the rod from the mold.

13. The method of claim 12, further comprising the steps of:

separating the first side piece from the second side piece; and removing the compressed smoking material from the pocket.

14. The method of claim 13, further comprising the step of wrapping the compressed smoking material with tobacco leaf after it has been removed from the pocket.

* * * * *